US006163993A

United States Patent [19]

Boehmke

[11] Patent Number: 6,163,993

[45] Date of Patent: Dec. 26, 2000

[54] SIMULATED ROCK NUMERICAL DISPLAY DEVICE

[76] Inventor: Philp A. Boehmke, 3312 Hidden Lake Dr., Woodstock, Ill. 60098

[21] Appl. No.: 09/325,079

[22] Filed: Jun. 3, 1999

[51] Int. Cl.[7] ..... G09F 9/00; G09F 1/08

[52] U.S. Cl. ..... 40/448; 40/538

[58] Field of Search ..... 40/448, 358, 452, 40/538; 472/137; 273/161, 138.1, 138.2, 459

[56] References Cited

U.S. PATENT DOCUMENTS

| | | | |
|---|---|---|---|
| 237,584 | 2/1881 | Ogle | 40/358 |
| D. 298,151 | 10/1988 | Torres et al. . | |
| D. 341,378 | 11/1993 | Becker et al. . | |
| 2,440,205 | 4/1948 | McLain | 40/538 X |
| 3,654,046 | 4/1972 | Crane | 428/46 |
| 4,033,257 | 7/1977 | Funahashi . | |
| 4,037,719 | 7/1977 | Perlmutter . | |
| 4,117,542 | 9/1978 | Klausner et al. | 364/900 |
| 4,227,342 | 10/1980 | Knowles | 273/454 X |
| 4,514,920 | 5/1985 | Shafrir et al. | 40/448 |
| 4,531,635 | 7/1985 | Cleveland . | |
| 4,754,852 | 7/1988 | Mule et al. . | |
| 4,942,841 | 7/1990 | Drucker, Jr. . | |
| 4,943,256 | 7/1990 | Symons . | |
| 5,112,276 | 5/1992 | Spaeth . | |
| 5,187,859 | 2/1993 | Kraelsky et al. | 472/137 |
| 5,280,834 | 1/1994 | Berkley . | |
| 5,574,268 | 11/1996 | Herman et al. . | |

*Primary Examiner*—Terry Lee Melius
*Assistant Examiner*—James M Hewitt
*Attorney, Agent, or Firm*—Dale J. Ream

[57] ABSTRACT

A simulated rock numerical display device includes a unitary solid body having an outer surface resembling a natural rock. The body further includes a base which forms a recess for holding a digital numeric display. The numeric display can be selectively set to a desired price and revealed during a sales transaction by a seller directing the base toward a buyer. Upstanding front, back, and side walls extend from the base and substantially converge at a top surface. The top surface includes an irregular contour indicative of a rock.

15 Claims, 7 Drawing Sheets

SIMULATED ROCK NUMERICAL DISPLAY DEVICE

BACKGROUND OF THE INVENTION

This invention relates generally to a numerical display device and, more particularly, to a numerical display device concealed within the base of a simulated natural rock to be revealed as "the rock bottom price" during a sales transaction.

Various devices are known for displaying the price at which consumer goods may be purchased. Certain consumer transactions, however, involve negotiations to arrive at the ultimate sales price of the goods. For example, automobile sales are typically characterized by a buyer and seller modifying their offers and asking prices as the features and drawbacks of an automobile are discussed until a satisfactory price is mutually agreed upon. During these negotiations, a buyer often inquires regarding the lowest or "rock bottom price" the seller is willing to accept for the vehicle. While existing price display devices are assumably effective for their intended purposes, such devices do not provide a price display that remains concealed within a natural object until the seller desires to reveal the lowest possible selling price.

Therefore, it is desirable to have a numerical display device which conceals a seller's lowest possible selling price until the seller desires to reveal it. Further, it is desirable to have a numerical display device which allows a seller to adjust quickly the price displayed by the device. It is also desirable that the device be in the form of an item not resembling a pricing device.

SUMMARY OF THE INVENTION

A numerical display device constructed according to the present invention including a unitary solid body having a base which allows upright positioning of the device on a support surface such as a desk. The body includes upstanding front, rear, and side walls converging at a top surface. Each surface presents a plurality of surface irregularities which resemble a natural rock. The base includes a recess on its lower surface for holding a numeric display. The numeric display may be liquid crystal display (LCD) having a plurality of digits that may be individually set to reflect a desired price. The price is concealed within the base until a seller chooses to reveal it during a sales transaction by lifting the body and directing the base toward the buyer.

It is therefore a general object of this invention to provide a numerical display device which can be set to display a desired price.

Another object of this invention is to provide a numerical display device, as aforesaid, which is in the form of a natural object.

Yet another object of this invention is to provide a numerical display device, as aforesaid, which conceals the numerical display until it is revealed by a user.

Still another object of this invention is to provide a numerical display device, as aforesaid, in which digits of a numerical display can be individually adjusted by a user.

A further object of this invention is to provide a numerical display device, as aforesaid, having an electronic numerical display device held within a natural-looking object.

A still further object of this invention is to provide a numerical display device, as aforesaid, which is battery powered.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
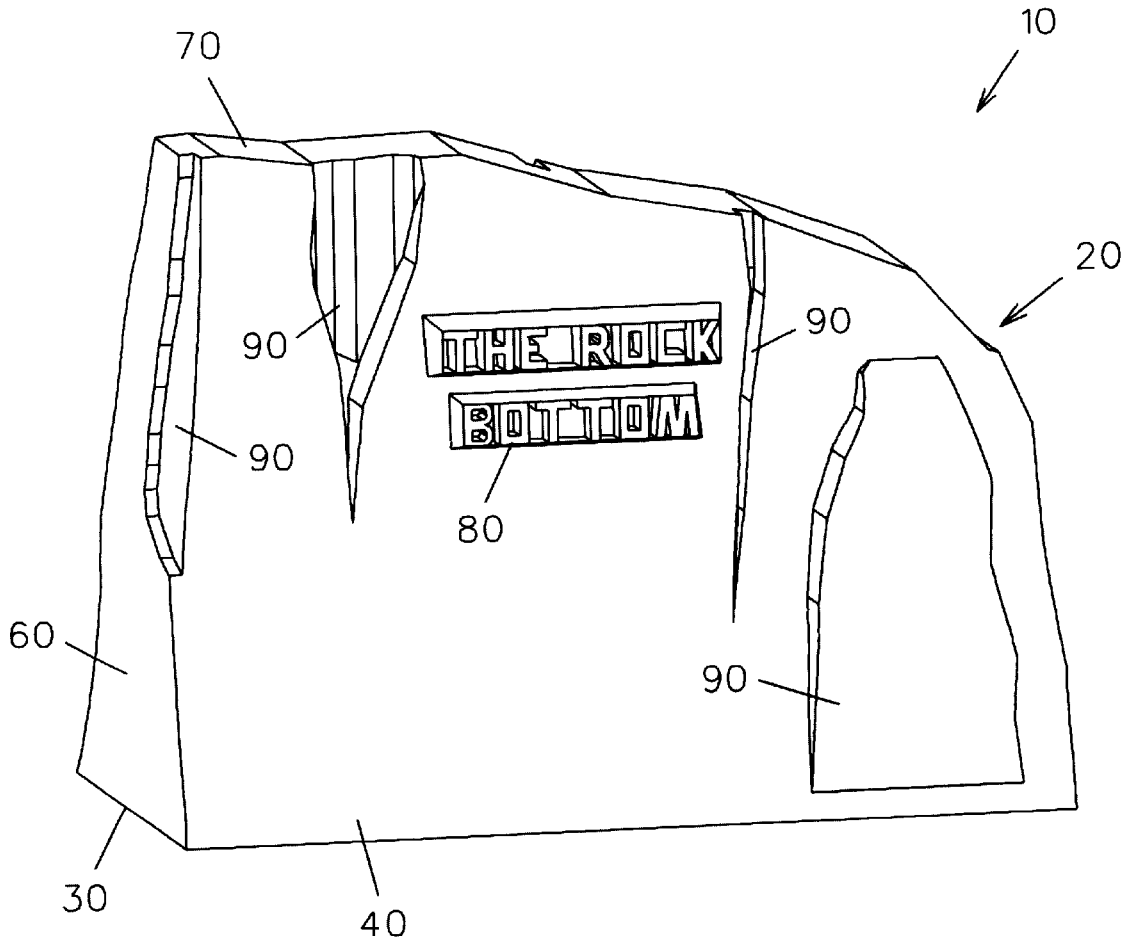
FIG. 1 is a perspective view of the simulated rock numerical display device according to the present invention.
Figure 2:
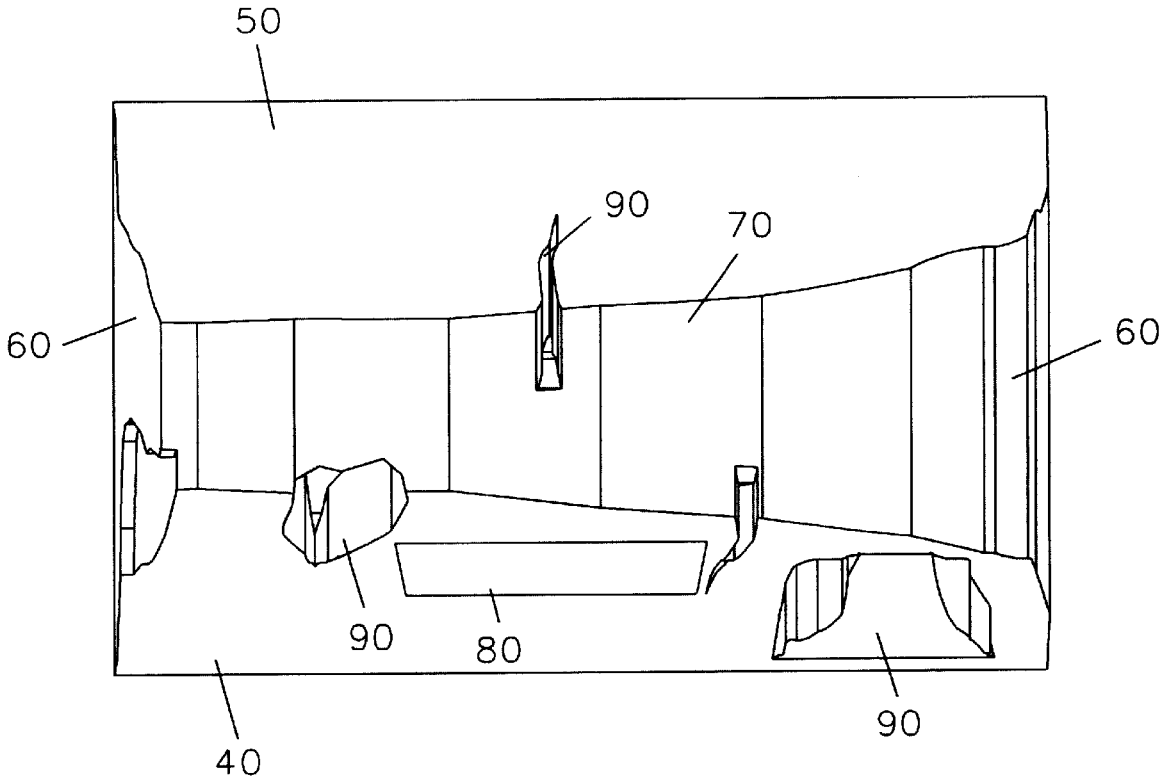
FIG. 2 is a top view of the device of FIG. 1.
Figure 3:
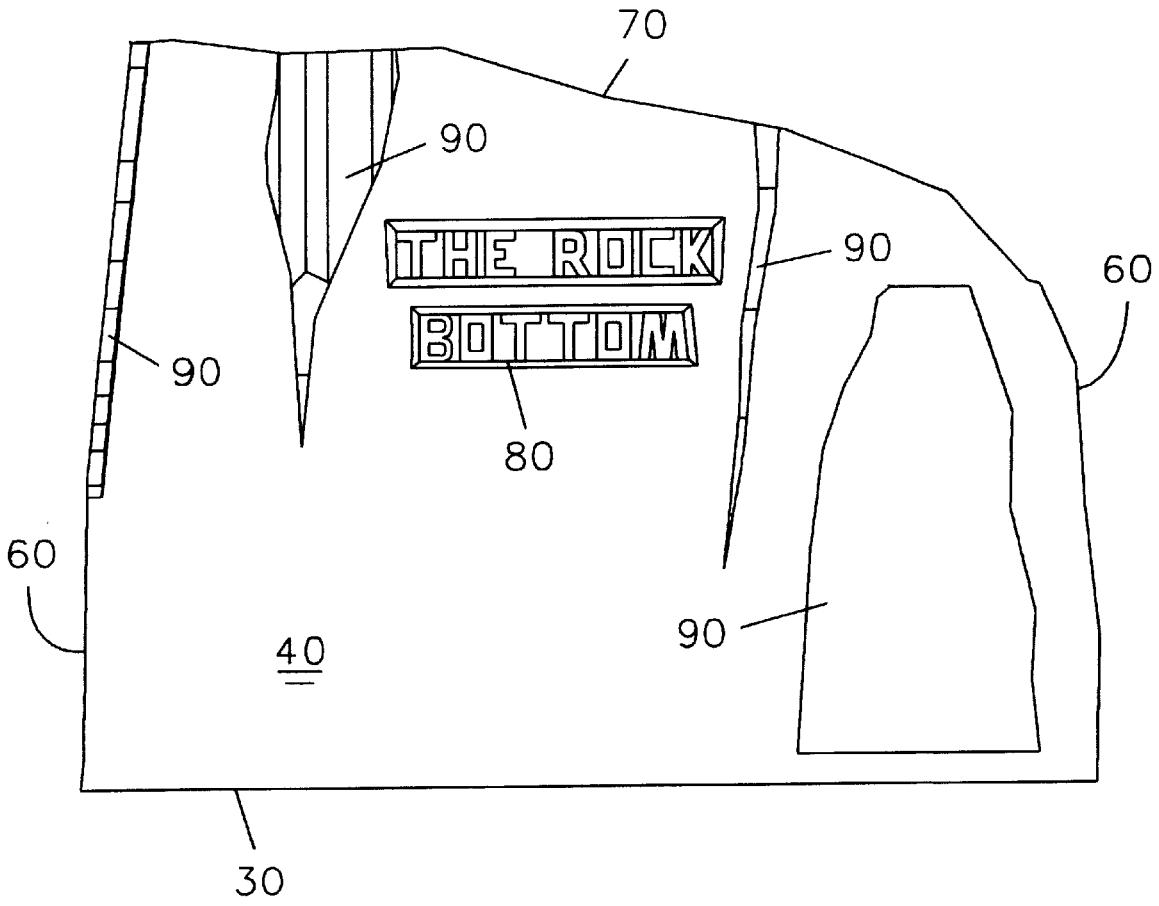
FIG. 3 is a front view of the device of FIG. 1.
Figure 4:
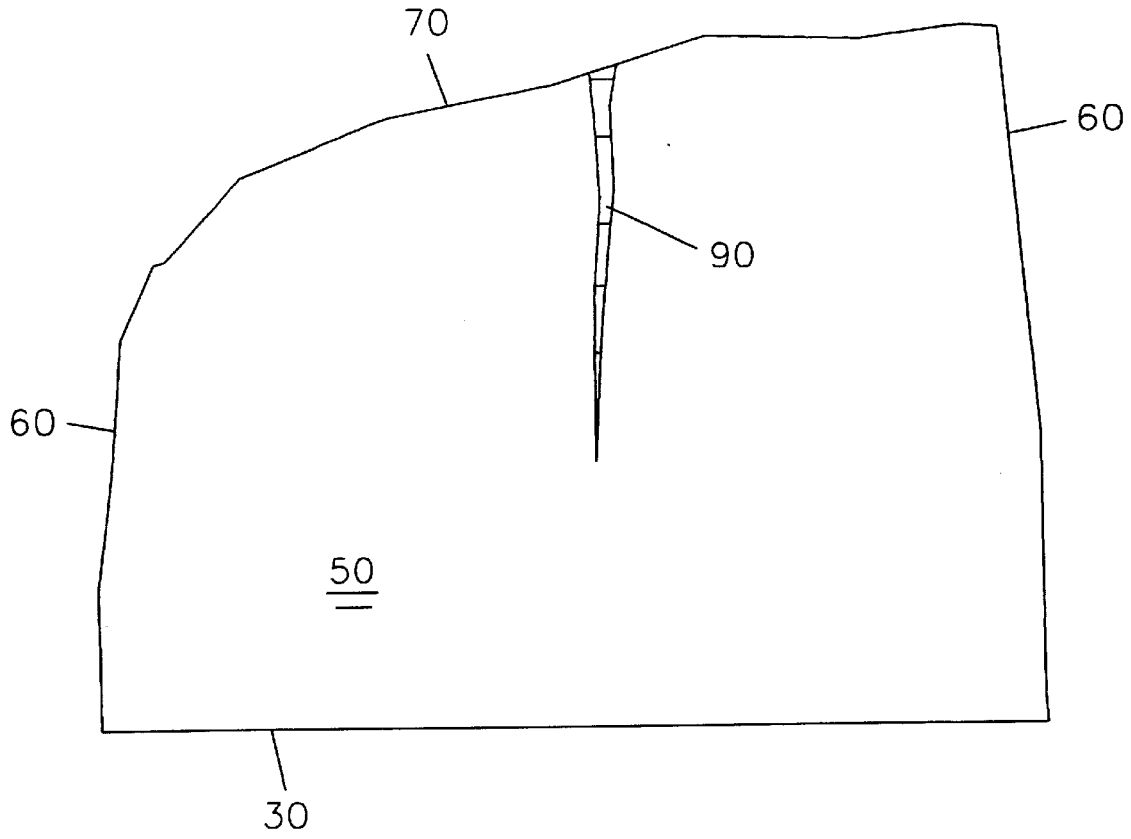
FIG. 4 is a back view of the device of FIG. 1.
Figure 5:
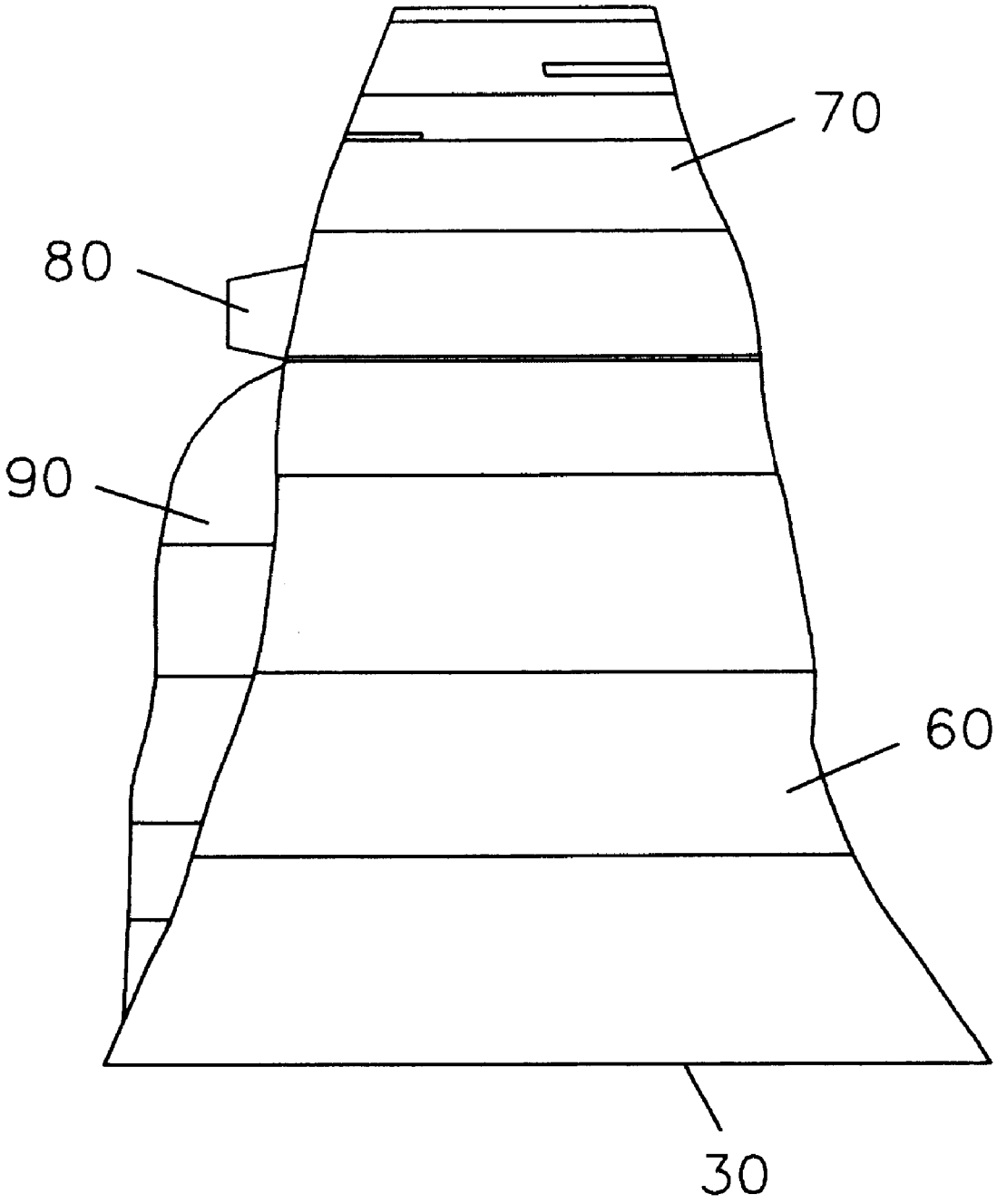
FIG. 5 is a right side view of the device of FIG. 1.
Figure 6:
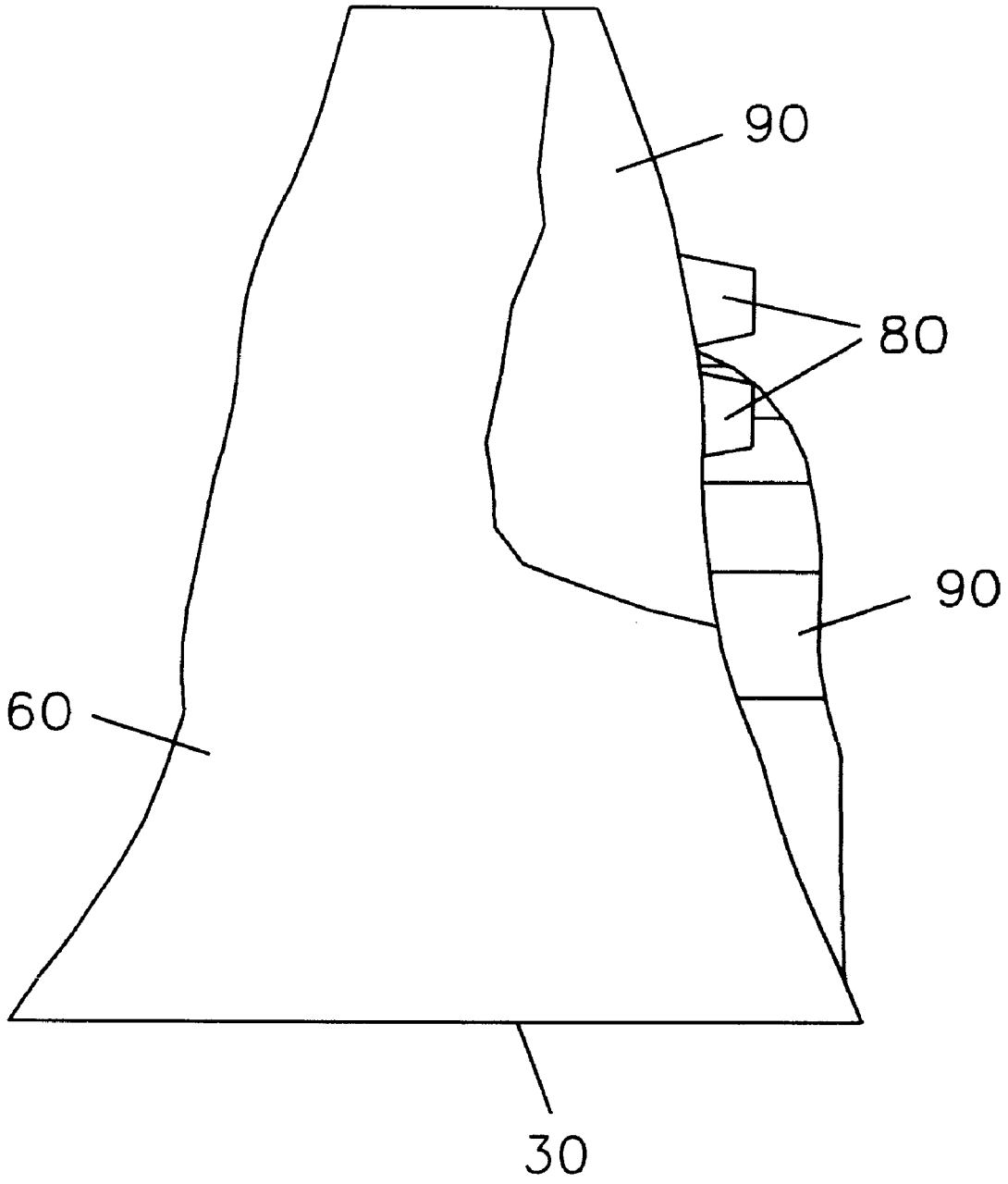
FIG. 6 is a left side view of the device of FIG. 1.

A simulated rock numerical display device 10 constructed according to the present invention is shown in FIGS. 1 through 6. The device 10 comprises a solid body 20 constructed of hard rubber although a rigid plastic or other similar material is also suitable. Preferably, the body 20 includes a generally rectangular base 30 which allows the device 10 to be placed in a stable, upright position upon a flat surface such as a desk. The device 10 includes upstanding front 40 and back 50 sides with side walls 60 extending therebetween. The front 40 and back 50 surfaces substantially converge at top 70. The top 70 presents an irregular contour that resembles a broken rock. The front 40, back 50, and side walls 60 include surface irregularities 90 indicative of a natural rock surface. The surfaces irregularities 90 are particularly designed to resemble cracks or chips characteristic of a rock. The front side 40 may also include indicia 80 indicative of a negotiated sales transaction.

Figure 7:
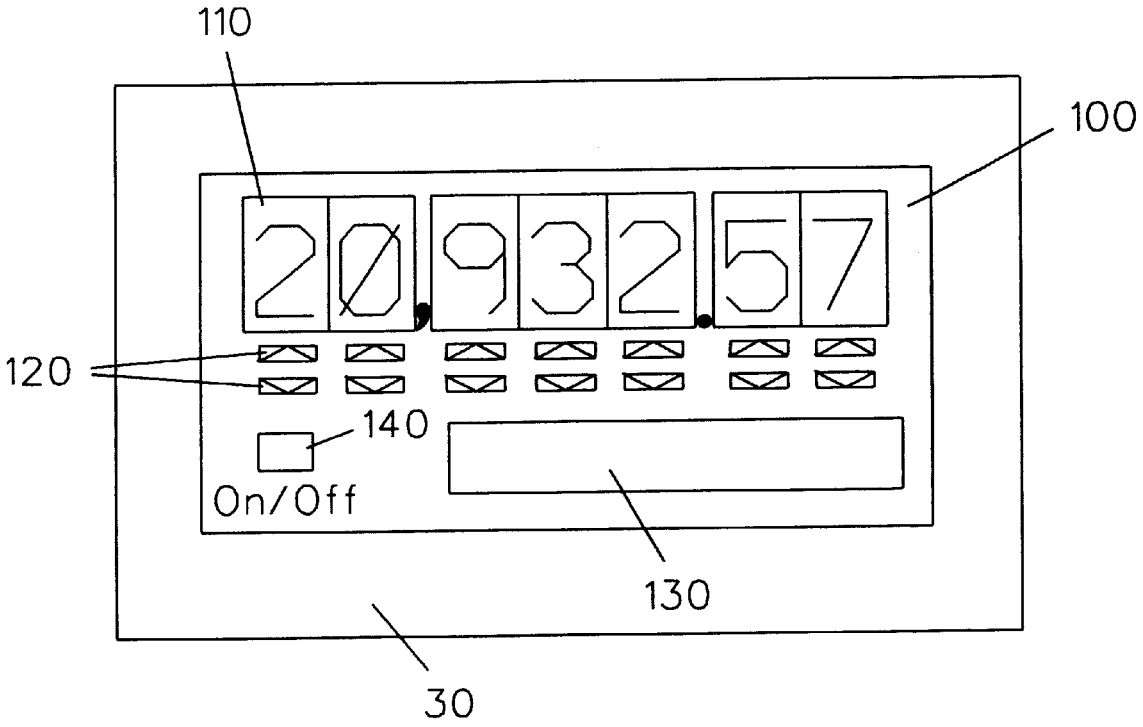
FIG. 7 is a bottom view of the device of FIG. 1 with each numeral of the numeric display set to a user-desired value.

The base 30 includes a shallow rectangular recess suitable for receiving a numeric digital display 100. The display 100 is held tightly within the recess in a friction fit relationship and may be removed and replaced by a similarly configured display if needed. Preferably, the digital display 100 includes a liquid crystal display (LCD) screen 110 having at least five numeric places for displaying the price of a consumer item ranging up to the tens of thousands of dollars (FIG. 7). Of course, the display 100 may also be configured to display other ranges of prices. A pair of buttons 120 correspond to each numeral of the LCD screen 110 for incrementing or decrementing the displayed number. Thus, a seller may quickly enter the lowest possible selling price by pressing the appropriate buttons 120. The display 100 is powered by batteries housed within a battery compartment 130 and is activated with an on/off button 140. It is understood that digital displays that can be adjusted by a user are known in the art. It is further understood that the numerical display 100 may be any analog or digital display or counter that can be housed within the body 20 of the device 10.

In use, a seller sets the numeric display 100 to indicate the lowest possible selling price for a relevant article of goods, such as an automobile. The device is placed upon the seller's desk or other desired surface while negotiating the price with a buyer. As the body 20 of the device 10 appears to be a rock and the display 100 is held within the base 30, the price remains concealed. When the buyer finally inquires as to the "rock bottom price" at which the seller is willing to sell the item, the seller may simply place the device 10 on its back side 50 or pick up the device 10 and direct the base 30 toward the buyer's eyes to reveal the lowest possible selling price.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A simulated rock device for displaying the price of an article, comprising:

a unitary solid body having a base with a recess formed therein, said body having a smooth outer surface with a plurality of irregular surface contours resembling rock cracks and chips disposed in arbitrary positions thereon indicative of a natural rock;

said body having a front wall extending from said base and a back wall extending from said base and substantially converging with said front wall to form a top wall; and means in said recess for displaying a price at which an article may be purchased, said body concealing said display means during a sales transaction until selectively revealed by a seller.

2. A device as claimed in claim 1 wherein, said top wall having an irregular contour indicative of a broken rock.

3. A device as claimed in claim 1 wherein said base is broad to allow upright positioning of said body.

4. A device as claimed in claim 1 wherein said base is formed of a rigid plastic material.

5. A device as claimed in claim 1 wherein said base is formed of rubber.

6. A device as claimed in claim 1 wherein said outer surface includes indicia indicative of a sales transaction.

7. A device as claimed in claim 1 wherein said display means is a liquid crystal display adapted to display a plurality of digits, said display having a pair of buttons corresponding to each said digit for setting the desired digits to be displayed.

8. A simulated rock device for displaying the price of an article, comprising:

a unitary solid body having a planar lower surface for resting said body upon a support surface, said lower surface defining a recess;

said body includes a front wall and a back wall substantially converging at a top surface;

an outer surface of said body having a plurality of surface irregularities resembling rock cracks and chips indicative of a natural rock; and display means within said recess for displaying a price, said display means visible for viewing upon a user lifting said body upward from said support surface.

9. A device as claimed in claim 8 wherein, the top surface having an irregular contour indicative of a broken rock.

10. A device as claimed in claim 9 wherein said body includes oppositely disposed side walls between said front and back walls such that said outer surface of said body is continuous.

11. A device as claimed in claim 8 wherein said base is broad to allow upright positioning of said body.

12. A device as claimed in claim 8 wherein said base is formed of a rigid plastic material.

13. A device as claimed in claim 8 wherein said base is formed of rubber.

14. A device as claimed in claim 8 wherein said outer surface includes indicia indicative of a sales transaction.

15. A device as claimed in claim 8 wherein said display means is a liquid crystal display adapted to display a plurality of digits, said display having a pair of buttons corresponding to each said digit for setting the desired digits to be displayed.

* * * * *

UNITED STATES PATENT AND TRADEMARK OFFICE

CERTIFICATE OF CORRECTION

PATENT NO. : 6,163,993
DATED : Dec. 26, 2000
INVENTOR(S) : Philip A. Boehmke

It is certified that error appears in the above-identified patent and that said Letters Patent is hereby corrected as shown below:

On the cover page, inventor's name, change "Philp" into --Philip--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*